United States Patent [19]

Dubrovsky et al.

[11] Patent Number: 4,502,315

[45] Date of Patent: Mar. 5, 1985

[54] DEVICE FOR CORRUGATING SHEET MATERIAL

[75] Inventors: Evgeny V. Dubrovsky; Viktor P. Dunaev; Anatoly I. Kuzin, all of Moscow, U.S.S.R.

[73] Assignee: Gosadarstvenny Sojuzny Nauchno-Issledovatelsky Traktorny Institut, Moscow, U.S.S.R.

[21] Appl. No.: 395,089

[22] PCT Filed: Jul. 30, 1981

[86] PCT No.: PCT/SU81/00066

§ 371 Date: Jun. 10, 1982

§ 102(e) Date: Jun. 10, 1982

[87] PCT Pub. No.: WO82/02009

PCT Pub. Date: Jun. 24, 1982

[30] Foreign Application Priority Data

Dec. 10, 1980 [SU] U.S.S.R. ..... 3210751

[51] Int. Cl.[3] ..... B21D 13/02; B21D 13/10

[52] U.S. Cl. ..... 72/385; 72/335; 72/379; 72/381; 264/286; 425/396

[58] Field of Search ..... 72/324, 327, 335, 379, 72/384, 385, 389, 381, 403, 382; 428/179, 180; 29/6.2; 264/286; 425/396

[56] References Cited

U.S. PATENT DOCUMENTS

| | | | |
|---|---|---|---|
| 1,677,438 | 7/1928 | Frohnhauser | 29/6.2 |
| 3,268,974 | 8/1966 | Felsenthal | 29/6.2 |
| 3,280,446 | 10/1966 | Borello | 29/6.2 |
| 3,570,086 | 3/1971 | Stone | 29/6.2 |
| 3,776,015 | 12/1973 | Chartet | 72/379 |
| 3,902,348 | 9/1975 | Hale | 72/379 |

FOREIGN PATENT DOCUMENTS

| | | | |
|---|---|---|---|
| 7211 | 5/1963 | Japan | 72/385 |
| 888636 | 1/1962 | United Kingdom | 72/385 |

*Primary Examiner*—Lowell A. Larson

*Attorney, Agent, or Firm*—Lilling & Greenspan

[57] ABSTRACT

A device for corrugating a sheet material with forming staggered cut corrugations, comprising a mechanism 1 for feeding a sheet material 2 to at least two punches 3, 4. The punches 3, 4 are mounted for reciprocating motion on both sides of the material 2 in the plane perpendicular to the plane of the material 2 and over the surface of the material 2 at right angles to the direction of its feeding. The device is provided with dies 12, 13 disposed on both sides of the punches 3, 4 in the direction of feeding the material 2, with a clearance being not less than the thickness of the material 2. The dies 12, 13 are adapted to reciprocate relative to the punches 3, 4 at right angles to the plane of the material 2 such that in the process of forming the corrugations the punches 3, 4 are forced in the material 2 between the oppositely lying dies.

4 Claims, 5 Drawing Figures

DEVICE FOR CORRUGATING SHEET MATERIAL

BACKGROUND OF THE INVENTION

1. Field of the Invention

The invention relates to plastic metal working and more particularly to devices for corrugating a sheet material with forming staggered cut corrugations.

The proposed invention may be used in devices for corrugating a sheet material with forming staggered cut corrugations, from materials having a different thickness, hardness, chemical composition and degree of surface roughness, and utilized as heat exchange inserts in heat exchange apparatus having wide applications.

2. Description of the Prior Art

Known in the prior art is a device for corrugating sheet material, comprising two interacting shafts made up of a plurality of cutting and forming plates provided with cutting edges arranged on involute teeth, the teeth of the adjacent plates of each shaft being offset through half a tooth pitch. The toothed shafts of such a device combine a sheet material feed mechanism with punches which corrugate the material and form staggered cut corrugations. The apex angle of a corrugation made by this device cannot be less than 100°. This makes such heat exchange inserts less compact as the pitch of the corrugation is more than 1.5 times greater than its height. Besides, in the process of cutting the sheet material burrs appear on the edges of cuts and grow in size as the operating time of the device increases. The value of an incomplete cutting of the sheet material at a joint of cuts is substantial. The quality of the corrugated heat exchange inserts with cut corrugations made by this device is rather low which limits its use in heat exchange apparatus.

Also known in the prior art is a device for corrugating a sheet material with forming staggered cut corrugations, comprising a mechanism for feeding sheet material to two punches installed for reciprocating motion on both sides of the material in the plane perpendicular to the plane of the material and associated with a mechanism for reciprocating the punches over the surface of the material in the plane perpendicular to the direction of its feeding. The punches are made in the form of combs provided with forming and cutting edges. The teeth of one punch are arranged opposite the tooth spaces of the other punch.

The profile of each tooth of the punches in cross-section is made in the form of an isosceles triangle having a rounded-off apex.

The sheet material is corrugated and staggered cut corrugations are formed in the following way.

The teeth of one punch force the sheet material by their rounded-off apexes into the tooth spaces of the other punch. At the same time the cutting edges of the rounded-off apex incise the sheet material. The final cutting is accomplished by the cutting edges of side surfaces and the final forming of a corrugation profile is effected by the side surfaces and the rounded-off apex of the punches.

The angle of cutting made by the side forming surfaces of the punches must not be less than 30° which is necessary to ensure the process of cutting the sheet material. As a result, the minimum pitch of a corrugation obtained by such a method of manufacture is restricted by the height of the corrugation and cannot be less than three quarters of the corrugation height. Such corrugated heat exchange inserts are less compact which limits their use in heat exchange apparatus.

Besides, due to a wearing effect of the sheet material on the cutting edges of punches, the latter get blunted with time. Burrs on the edges of cuts in the sheet material grow in size. The value of an incomplete cutting of the sheet material at a joint of cuts increases. As a result, the thermohydraulic effectiveness and quality of the corrugated heat exchange inserts made by this device get substantially declined in the process of the device operation and a frequent replacement of the punches is required.

Summary of the Invention

The present invention seeks to provide a device for corrugating a sheet material with forming staggered cut corrugations, in which a process of forming the corrugations and making cuts by cutting the sheet material would be replaced with a process of forming the corrugations and making the cuts by breaking the sheet material.

This invention is accomplished by a device for corrugating a sheet material arranged to advance in a feeding direction and defining a feeding plane and forming staggered cut corrugations, comprising: at least two forming punches arranged in opposition to each other in a common plane normal to said feeding plane. One punch is stationary, while the other punch is capable of performing reciprocating motion relative to the stationary punch within the plane in which they are arranged; and further comprising a mechanism for feeding the sheet material to the punches; said punches being arranged in such a manner as to be capable of performing together reciprocating motion within the plane in which they are arranged perpendicularly to the direction of reciprocating motion of said movable punch and also capable of cooperating with a mechanism for reciprocating the punches for performing reciprocating motion of the punches within the plane in which they are arranged perpendicularly to the direction of motion of said movable punch, according to this invention the device further comprises dies disposed on both sides of said punches, with a clearance defined by the outer surfaces of said punches and the inner surfaces of said dies and equal to at least the thickness of the sheet material being corrugated; said dies being arranged so as to be capable of performing reciprocating motion relative to said punches in the direction of motion of said movable punch within the planes running parallel to the plane in which said punches are arranged in such a manner that in the process of forming corrugations said punches force the sheet material between the oppositely lying dies.

This makes it possible to eliminate the direct contact of the sheet material with the cutting edges of the side surfaces of the punches and to replace the forming of corrugation cuts by the cutting method with a method of forcing through and breaking the sheet material.

To form cut corrugations on sheet materials of different widths, it is more advantageous to make the device with a plurality of punches having a forming surface and disposed on both sides of the sheet material such that the punches disposed on one side of the sheet material are joined with one another at intervals equal to the width of the punches disposed on the other side of the material opposite to these intervals.

To ensure a more qualitative forming of edges of the cut corrugations in the process of corrugating sheet materials having a substantial surface roughness, considerable thickness or a microstructure of nonuniform hardness, the device may be suitably provided with a mechanism for forming portions of reduced section on the sheet material, installed in front of the punches in the direction of the material feeding such that it forms the portions of reduced section on both sides of the material with a pitch equal to the width of the punches.

The best quality in forming the edges of cut corrugations and the highest thermohydraulic characteristics of the corrugated heat exchange surface with cut corrugations are ensured by the device being provided with a mechanism for forming portions of reduced section on the sheet material, made in the form of a pair of rolls disposed on both sides of the material and provided with pointed projections arranged one opposite another with a pitch equal to the width of the punches.

BRIEF DESCRIPTION OF THE DRAWINGS

The invention will now be described in greater detail with reference to a specific embodiment thereof, taken in conjunction with the accompanying drawings, wherein.

DESCRIPTION OF THE PREFERRED EMBODIMENTS

Figure 1:
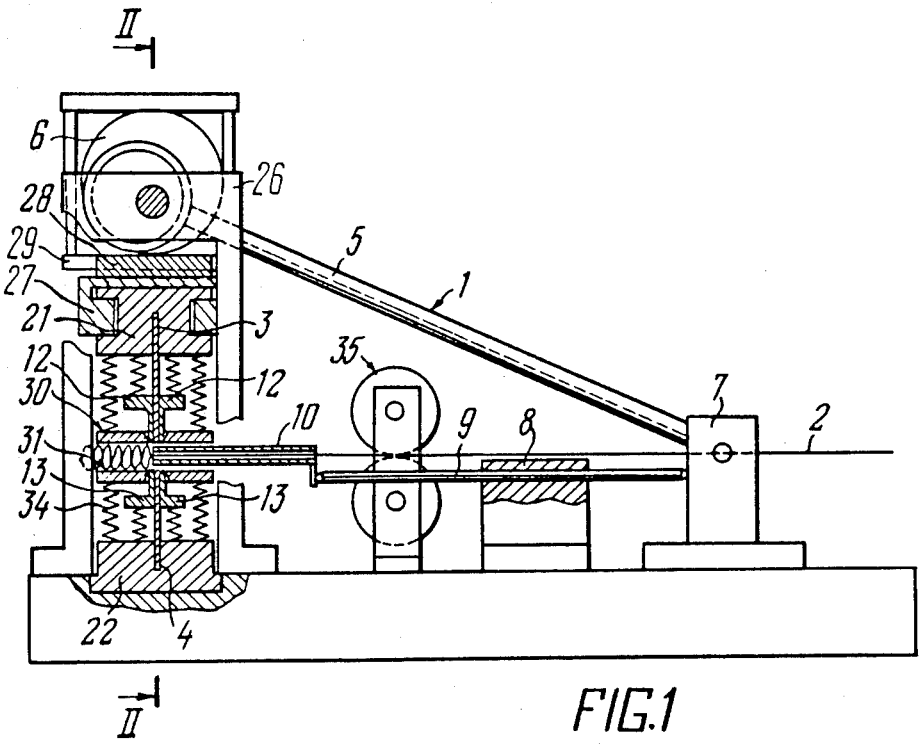
FIG. 1 illustrates a said elevational view of the device for corrugating a sheet material, according to the invention.
Figure 2:
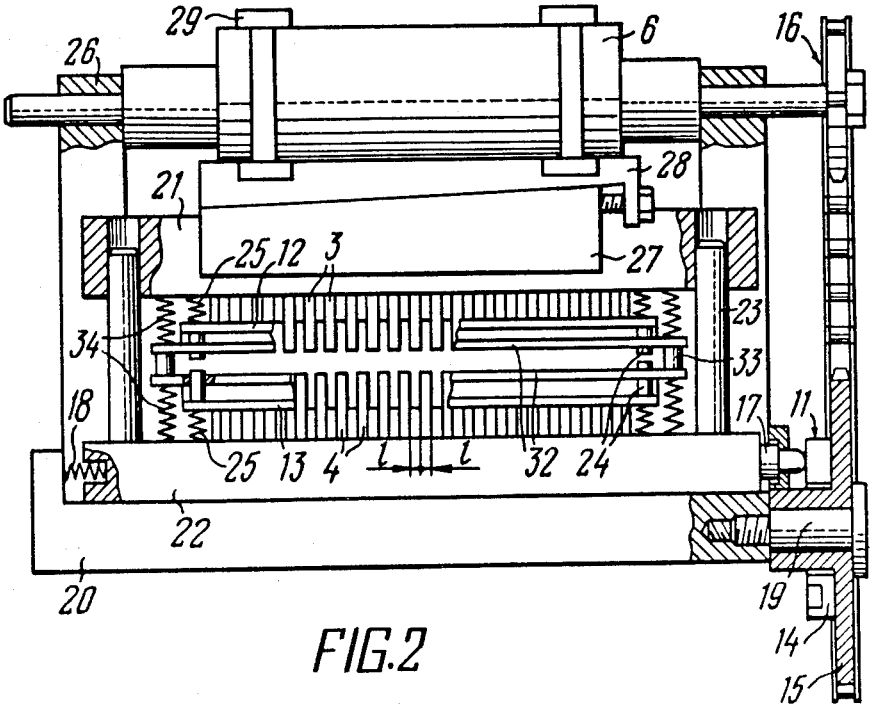
FIG. 2 is a section taken along the line II—II of FIG. 1.

A device for corrugating a sheet material, according to the invention, is illustrated in FIGS. 1, 2.

The device comprises a feed mechanism 1 (FIG. 1) for feeding a sheet material 2 (FIGS. 1, 3, 4) along a feeding direction in a feeding plane to top and bottom punches 3, 4 (FIGS. 1, 2, 3) respectively, made, for example, of a rod 5 (FIG. 1) associated with an eccentric shaft 6 (FIGS. 1, 2), a slider 7 (FIG. 1), a guide 8, a bar 9 and a carriage 10.

The punches 3, 4 (FIGS. 1, 2, 3) are arranged within the same plane on opposite sides of the feeding plane of the sheet material 2. The punch 4 is stationary, while the punch 3 is mounted so as to be capable of performing reciprocating motion relative to the stationary punch 4 within the plane in which they are arranged. Both of the punches 3, 4 are arranged so as to together reciprocate within the plane in which they are arranged perpendicularly to the direction of the reciprocating motion of the movable punch 3. The punches 3, 4, cooperate with a mechanism 11 (FIG. 2) for reciprocating the punches 3, 4 (FIGS. 1, 2, 3) and causing them to perform reciprocating motion within the plane in which the punches 3, 4 are arranged perpendicularly to the direction of motion of the movable punch 3 or normal to the feeding direction.

Top 12 and bottom 13 dies are arranged on both sides of the top 3 and bottom 4 punches, respectively.

Figure 3:
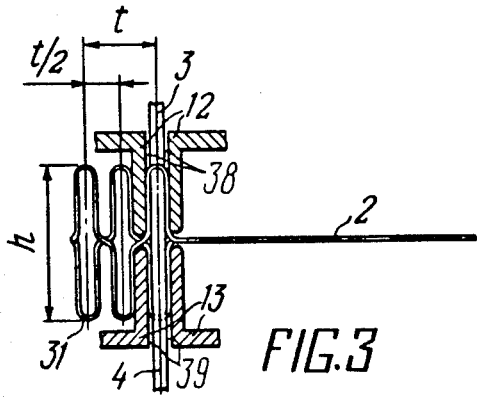
FIG. 3 illustrates diagrammatically a relative position of punches and dies in the process of forming cut corrugations.
Figure 4:
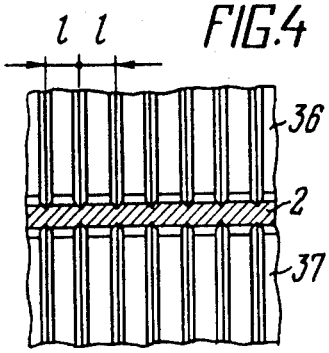
FIG. 4 illustrates a mechanism for forming portions of reduced section on the sheet material.

The dies 12, 13 are disposed on both sides of the punches 3, 4 with clearances 38, 39 (FIG. 3) formed between the outer surfaces of the punches 3, 4 (FIGS. 1, 2, 3) and the inner surfaces of the dies 12, 13. These clearances 38, 39 are at least equal to the thickness of the sheet material 2 being corrugated (FIGS. 1, 3, 4).

The dies 12, 13 (FIGS. 1, 2, 3) are arranged so as to be capable of performing reciprocating motion relative to the punches 3, 4 in the direction of motion of the movable punch 3 within the planes running parallel to the plane in which the punches 3, 4 are arranged.

Figure 5:
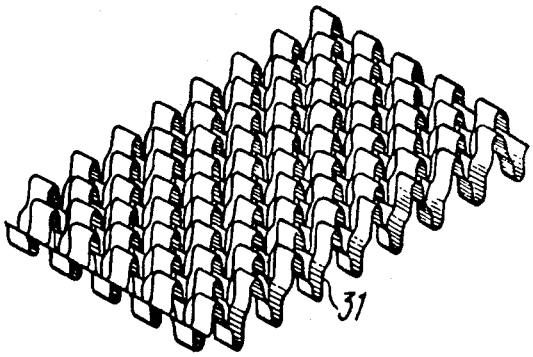
FIG. 5 illustrates a ready corrugated sheet material with cut corrugations.

To form corrugations 31 (FIGS. 1, 3, 5), the punches 3, 4 (FIGS. 1, 2, 3) force the sheet material 2 (FIGS. 1, 3, 4) into the clearances 38, 39 (FIG. 3) between the oppositely lying dies 13 and 12 (FIGS. 1, 2, 3), respectively.

In the proposed design the reciprocating mechanism 11 (FIG. 2) of the punches 3, 4 (FIGS. 1, 2, 3) is made, for example, in the form of a cam 14 (FIG. 2) secured on a driven sprocket 15 of a chain drive 16 associated with the eccentric shaft 6 (FIGS. 1, 2), a pushrod 17 (FIG. 2) and springs 18. The sprocket 15 is free to rotate on an axle 19 secured in a plate 20.

The top and bottom punches 3, 4 (FIGS. 1, 2, 3) are secured respectively in top and bottom sliders 21, 22 (FIGS. 1, 2) associated with each other by columns 23 (FIG. 2).

The top and bottom dies 12 and 13 (FIGS. 1, 2, 3) respectively comprise stops 24 (FIG. 2) limiting the travel thereof in the plane perpendicular to the plane of the sheet material 2 (FIGS. 1, 3, 4) and respectively associated with the top and bottom sliders 21, 22 (FIGS. 1, 2) through the medium of springs 25 (FIG. 2).

The top slider 21 (FIGS. 1, 2) is associated with the eccentric shaft 6 mounted on posts 26, through the medium of a saddle 27 (FIG. 2), a wedge 28 and a link gear 29.

The top slider 21 and bottom slider 22 are arranged so as to be capable of together performing reciprocating motion relative to the stationary saddle 27 and plate 20 (FIG. 2), respectively, within the plane in which the punches 3, 4 (FIGS. 1, 2, 3) are arranged perpendicularly to the direction of reciprocating motion of the movable punch 3.

The saddle 27 (FIGS. 1, 2) is movable relative to the stationary wedge 28 for adjusting the predetermined height (FIG. 3) of corrugations.

The link gear 29 (FIGS. 1, 2) is intended for conversion of rotary motion of the eccentric shaft 6 into reciprocating motion of the movable punch 3".

A mechanism 30 (FIG. 1) for removing a ready corrugated sheet material 31 (FIGS. 1, 3, 5) with cut corrugations comprises lifters 32 (FIG. 2) with limit stops 33 mounted thereon, associated with the top and bottom sliders 21, 22 (FIGS. 1, 2), respectively, through the medium of springs 34.

The proposed device for corrugating a sheet material with forming staggered cut corrugations operates in the following manner.

The sheet material 2 (FIGS. 1, 3, 4) is fed along the guide 8 (FIG. 1) through the carriage 10 toward the punches 3, 4 (FIGS. 1, 2, 3).

When the eccentric shaft 6 (FIGS. 1, 2) turns, the link gear 29 (FIG. 2) acting through the wedge 28 and the saddle 27 presses on the top slider 21 (FIGS. 1, 2), the top punches 3 (FIGS. 1, 2, 3) secured therein and through the springs 25 (FIG. 2), on the top dies 12 (FIGS. 1, 2, 3). The top dies 12, through the stops 24 (FIG. 2) thereof, rest on the stops 24 of the bottom die 13 (FIGS. 1, 2, 3).

At the same time the top punches 3 press on the sheet material 2 (FIGS. 1, 3, 4) and while moving relative to the dies 12, 13 (FIGS. 1, 2, 3) break it through by their radiused portion, force it between the oppositely lying dies 13 and enter the spaces between the bottom punches 4. The bottom punches 4 break through the sheet material, force it in between the oppositely lying dies 12 and enter the spaces between the top punches 3. As a result, the sheet material 2 (FIGS. 1, 3, 4) is broken at places preliminarily broken through by the radiused portion of the punches, forming the cut corrugation of a required height h.

When the eccentric shaft 6 (FIGS. 1, 2) turns further, the top punches 3 (FIGS. 1, 2, 3) are withdrawn from the spaces between the bottom punches 4. Under the action of the springs 25 (FIG. 2) the dies 12, 13 return to the initial position. The lifters 32 actuated by the springs 34 (FIGS. 1, 2) remove the ready corrugated material 31 (FIGS. 1, 3, 5) with cut corrugations from the punches 3, 4 (FIGS. 1, 2, 3) and the dies 12, 13.

From the eccentric shaft 6 (FIGS. 1, 2) the torque is transmitted to the driven sprocket 15 (FIG. 2) through the chain drive 16. The cam 14 turns together with the sprocket 15 and moves the pushrod 17 acting on the bottom slider 22 (FIGS. 1, 2). The top slider 21 and the bottom slider 22 with the punches 3 and 4 (FIGS. 1, 2, 3) secured thereon, move together with the dies 12, 13 in horizontal planes and in directions at right angles to the direction of feeding the sheet material 2 (FIGS. 1, 3, 4) for a distance 1 equal to the width of the punches 3, 4 (FIGS. 1, 2, 3). At the same time the eccentric shaft 6 (FIGS. 1, 2) shifts the slider 7 (FIG. 1) through the rods 5, thereby acting through the bar 9 on the carriage 10 which, while moving, grips the ready corrugated sheet material 31 (FIGS. 1, 3, 5) with cut corrugations and feeds the sheet material 2 (FIGS. 1, 3, 4) for a required distance toward the top and bottom punches 3, 4 (FIGS. 1, 2, 3), respectively. The process of forming the corrugations described herein before is repeated.

After removal of the ready corrugated sheet material 31 (FIGS. 1, 3, 5) with cut corrugations the cam 14 (FIG. 2) ceases to act on the pushrod 17. The springs 18 move the top and bottom sliders 21, 22 (FIGS. 1, 2) with the punches 3, 4 (FIGS. 1, 2, 3) and the dies 12, 13, respectively for the distance 1 to the initial position.

The feed mechanism 1 (FIG. 1) of the sheet material 2 (FIGS. 1, 3, 4) feeds the sheet material 2 for a required distance. The cycle is repeated.

The profile in cross-section of the ready corrugated sheet material 31 (FIGS. 1, 3, 5) with staggered cut corrugations produced by the device of the invention is more complicated in shape than the profile of the material produced by the analogous and prior art devices. However, the proposed design improvements make it possible to substantially improve the compactness of the formed corrugated heat exchange insert. This is explained by the fact that in the proposed device for corrugating the sheet material 2 (FIGS. 1, 3, 4) a corrugation pitch t (FIG. 3) is not dependent on the corrugation height h and depends only on the thickness of the sheet material 2 (FIGS. 1, 3, 4) and the design thickness of the punches 3, 4 (FIGS. 1, 2, 3) and the dies 12, 13.

In addition, the ready corrugated sheet material 31 (FIGS. 1, 3, 5) with cut corrugations formed by the device of the invention have the edges of cuts practically free from burrs and the value of an incomplete cutting of the sheet material 2 (FIGS. 1, 3, 4) at the places of cuts is brought to a minimum. This effect is achieved due to replacing the process of cutting the sheet material 2 with the process of its breaking. Durability of such a device is substantially higher as there is no need for frequent replacement or sharpening of the punches. In the process of the device operation the quality of the formed corrugations remains constant and does not change with time.

All this ensures high thermohydraulic characteristics of the corrugated heat exchange surface with cut corrugations.

The device for corrugating the sheet material 2 may suitably be provided with a mechanism 35 (FIG. 1) for forming portions of reduced section made, for example, in the form of a pair of rolls 36, 37 (FIG. 4) disposed on both sides of the sheet material 2 (FIGS. 1, 3, 4) and provided with pointed projections arranged oppositely to one another with the pitch l (FIG. 4) equal to the width of the punches 3, 4 (FIGS. 1, 2, 3).

In this case the sheet material 2 (FIGS. 1, 3, 4) is fed along the guides 8 (FIG. 1) and passes respectively between the top and bottom rolls 36 and 37 (FIG. 4) and through the carriage 10 (FIG. 1) toward the punches 3, 4 (FIGS. 1, 2, 3). As the sheet material 2 (FIGS. 1, 3, 4) passes through the rolls 36, 37 (FIG. 4), the latter through the medium of their pointed projections form the portions of reduced section on the surface of the sheet material 2 (FIGS. 1, 3, 4) from both sides thereof. Further the sheet material 2 is fed through the carriage 10 (FIG. 1) toward the punches 3, 4 (FIGS. 1, 2, 3) so that the portions of reduced section on the sheet material 2 (FIGS. 1, 3, 4) are registered with the edges of the punches 3, 4 (FIGS. 1, 2, 3). The process of corrugating the sheet material 2 (FIGS. 1, 3, 4) similar to that described herein before is commenced.

Forming the portions of reduced section on the sheet material 2 by the device makes it possible to obtain a higher quality edge of the cut corrugation especially when using a material having a high degree of surface roughness or a surface microstructure of nonuniform hardness on which the edges of cuts may form at random places with a lesser tensile strength.

A higher quality of the edges of cut corrugations is obtained when using the device for corrugating the sheet material 2, provided with the mechanism for forming portions of reduced section, also in the case of working on the sheet material 2 of a substantial thickness.

The thermohydraulic characteristics of a corrugated heat exchange surface with cut corrugations made by the device provided with the mechanism for forming portions of reduced section, will be of the highest values.

The use of the device of the invention will make it possible to form staggered cut corrugated heat exchange inserts from sheet materials having a different thickness, hardness, chemical composition and degree of surface roughness. The quality and the thermohydraulic effectiveness of heat exchange inserts made by this device will remain constant for a prolonged period of the device operation and will be of higher values when compared to heat exchange inserts with cut corrugations, made by other known devices.

We claim:

1. A device for corrugating sheet material advanced along a feeding direction in a feeding plane and forming staggered-cut corrugations (31), comprising at least two punches (3,4) arranged in a common plane substantially normal to the directions of movements of the sheet material and said two punches (3,4) being staggered from each other on opposite sides of the plane of feeding the material—one of the punches (4) being static and means for reciprocating the other of the punches (3) with respect to the static punch (4) in the plane in which said punches (3,4) are arranged—and a mechanism (1) for feeding the sheet material to the punches (3,4) and means for reciprocating the punches (3,4) in the plane in which said punches (3,4) are arranged in a direction at right angles to the direction of reciprocation of the movable punch (3); and dies (12,13) arranged on both side of the punches (3,4) so that clearances (38,39) thus formed between the outer forming surfaces of the punches (3,4) and the surfaces of the cavities of the dies (12,13) are at least equal to the thickness of the sheet material (2) corrugated, and means for reciprocating the dies (12,13) with respect to the punches (3,4) in planes that are parallel to the plane in which said punches (3,4) are arranged and in a direction of reciprocation of the movable punch (3) so that said punches (3,4) force the sheet material (2) between the opposing dies (12,13) to break the sheet material and form the staggered-cut corrugations (31).

2. A device for corrugating sheet material as claimed in claim 1, characterized in that a plurality of forming punches (3,4) are incorporated thereinto and are shifted one relative to the other for displacement relative to the other in the plane in which said punches are arranged for relative movements in opposite direction in said common plane, the movable punches (3) being linked to each other so that gaps are formed therebetween of a width equalling the width of the static punches (4) which, in their turn, are also interlinked and arranged opposite the gaps between the movable punches (3).

3. A device for corrugating sheet material as claimed in claims 1 or 2, characterized in that a mechanism (35) is incorporated thereinto to form segments with a reduced cross-sectional area in the sheet material (2) which is located upstream of the punches (3, 4) relative to the direction of feeding of the sheet material so that the segments of a reduced cross-sectional area are formed with a pitch equalling the width of the punches (3, 4) on both side of the sheet material (2).

4. A device for corrugating a sheet material according to claim 3, characterized in that the mechanism (35) for forming portions of reduced section on the sheet material (2) is made in the form of a pair of rolls (36, 37) disposed on both sides of the material (2), and provided with pointed projections arranged one opposite the other with a pitch equal to the width of the punches (3, 4).

* * * * *